US006217403B1

(12) United States Patent
Chakravorty et al.

(10) Patent No.: US 6,217,403 B1
(45) **Date of Patent: *Apr. 17, 2001**

(54) GATE ELECTRODE FORMATION METHOD

(75) Inventors: Kishore K. Chakravorty; Philip J. Elizondo, both of San Jose, CA (US)

(73) Assignee: Candescent Technologies Corporation, San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/425,835

(22) Filed: Oct. 21, 1999

Related U.S. Application Data

(63) Continuation of application No. 08/889,622, filed on Jul. 7, 1997, now Pat. No. 6,039,621.

(51) Int. Cl.[7] ..... H01J 9/02
(52) U.S. Cl. ..... 445/24
(58) Field of Search ..... 445/24, 49, 50

(56) References Cited

U.S. PATENT DOCUMENTS 5,283,500 * 2/1994 Kochanski ..... 313/309
5,865,657 2/1999 Haven et al. ..... 445/24
5,865,659 2/1999 Ludwig et al. ..... 445/50
6,039,621 * 3/2000 Chakravorty ..... 445/24

* cited by examiner

*Primary Examiner*—Kenneth J. Ramsey
(74) *Attorney, Agent, or Firm*—Wagner, Murabito & Hao LLP

(57) ABSTRACT

A method for forming a gate electrode. In one embodiment, the present invention comprises depositing a gate metal over an underlying substrate such that a layer of the gate metal is formed above the underlying substrate. In the present invention, the layer of the gate metal is deposited to a thickness approximately the same as the thickness desired for the gate electrode. Next, the present invention deposits polymer particles onto the layer of gate metal. A hard mask layer is then deposited over the polymer particles and the layer of the gate metal. The present invention removes the polymer particles and portions of the hard mask layer which overlie the polymer particles such that first regions of the layer of the gate metal are exposed, and such that second regions of the layer of the gate metal remain covered by the hard mask layer. After the removal step, the present invention etches through the first regions of the layer of the gate metal such that openings are formed completely through the layer of the gate metal at the first regions. After the openings have been formed, the remaining portions of the hard mask layer which overlie the second regions of the layer of the gate metal are removed.

9 Claims, 7 Drawing Sheets

GATE ELECTRODE FORMATION METHOD

This is continuation of application Ser. No. 08/899,622 filed on Jul. 7, 1997 now U.S. Pat. No. 6,039,621, which is hereby incorporated by reference to this specification.

FIELD OF THE INVENTION

The present claimed invention relates to the field of flat panel displays. More particularly, the present claimed invention relates to the formation of a gate electrode for a flat panel display screen structure.

BACKGROUND ART

In certain flat panel display devices such as, for example, flat display devices utilizing cold cathodes, a gate electrode is required. In such flat panel display devices, an electron emissive cold cathode is disposed between a first electrode (e.g. a row electrode) and a second electrode (e.g. a gate electrode). By generating a sufficient voltage potential between the row electrode and the gate electrode, the electron emissive cold cathode is caused to emit electrons. In one approach, the emitted electrons are accelerated, through openings in the gate electrode, towards a display screen. In such flat panel display devices, it is desirable to have the openings uniformly and consistently arranged with sufficient spacing provided between each opening to avoid overlapping in the gate electrode.

With reference now to Prior Art FIG. 1, a side sectional view of a conventional process step used in the formation of a prior art gate electrode is shown. As shown in Prior Art FIG. 1, a first electrode 102 has an insulating layer 104 disposed thereon. In a conventional gate electrode formation process, a non-insulating material is deposited on top of insulating layer 104 to form a very thin non-insulating layer 106 (e.g. on the order of 100 angstroms) of the non-insulating material.

With reference now to Prior Art FIG. 2, conventional gate electrode formation processes then deposit spheres, typically shown as 108, onto very thin non-insulating layer 106. Because layer 106 is very thin, it is extremely difficult for such prior art gate electrode formation processes to make very thin non-insulating layer 106 continuous. As a result, spheres 108 are not uniformly or consistently deposited across the surface of very thin non-insulating layer 106 in conventional gate electrode formation processes.

With reference next to Prior Art FIG. 3, a second layer of non-insulating material 110 is then deposited over the very thin non-insulating layer 106 and over spheres 108. As shown in Prior Art FIG. 3, second layer of non-insulating material 110 is much thicker than very thin layer of non-insulating material 106. In such prior art approaches, very thin non-insulating layer 106 together with second non-insulating layer 110 comprise the body of the gate electrode.

As shown in Prior Art FIG. 4, after the deposition of second non-insulating layer 110, spheres 108 and portions of second non-insulating layer 110 which overlie spheres 108 are removed. As a result, regions, typically shown as 112, of very thin non-insulating layer 106 have second non-insulating layer 110 removed therefrom.

Referring still to Prior Art FIG. 4, after the removal of spheres 108 and portions of second non-insulating layer 110 which overlie spheres 108, an etch step is performed. The etch step is used to form openings through very thin non-insulating layer 106. As mentioned above, spheres 108 are not uniformly or consistently disposed across the surface of very thin non-insulating layer 106 in conventional gate electrode formation processes. Consequently, conventionally formed openings in second non-insulating layer 110 and very thin non-insulating layer 106 are likewise not uniformly or consistently disposed across the surface of very thin non-insulating layer 106. In addition to forming openings through second non-insulating layer 110 and very thin non-insulating layer 106, the etch step of conventional gate electrode formation processes also substantially etches second non-insulating layer 110. The etching of second non-insulating layer 110 reduces the thickness thereof. Therefore, second non-insulating layer 110 must be deposited to a thickness which is greater than the desired thickness of the gate electrode, so that second non-insulating layer 110 will be of the desired thickness after being subjected to the etch environment. Thus, conventional gate electrode formation processes reduce the thickness of the gate electrode across the entire surface thereof when etching openings through the gate electrode, as shown in Prior Art FIG. 5.

Referring again to Prior Art FIG. 5, as yet another drawback, during etch steps of the above-described gate electrode formation process, the top surface of second non-insulating layer 110 is subjected to the etch environment. In addition to reducing the thickness of second insulating layer 110, the etch environment induces deleterious effects such as, for example, oxidation at the top surface of second non-insulating layer 110. Oxidation of the top surface of second non-insulating layer 110 complicates other processes such as the removal of subsequently deposited emitter material. Thus, conventional gate electrode formation processes subject the gate electrode to unwanted etching, and degrade the surface integrity of the gate electrode.

As still another drawback, thickness uniformity of the gate film remaining after an etch process crucially depends on the etch uniformity of the etch system employed. In large area panels, such etch non-uniformity is a major concern, because it is extremely difficult to achieve sufficient etch uniformity across the large area panels. The problem of etch non-uniformity is further exacerbated when etching through submicron features.

Thus, a need exists for a gate electrode formation method which provides for improved spacing of openings formed through the gate electrode. Another need exists for a gate electrode formation process which does not reduce the thickness of the gate electrode across the entire surface thereof when etching openings through the gate electrode. Yet another need exists for a method which provides a gate electrode having good surface integrity and an undamaged top surface after the formation thereof.

SUMMARY OF INVENTION

The present invention is comprised of a method which provides for improved spacing of openings formed through the gate electrode. The present invention further comprises a method which does not reduce the thickness of the gate electrode across the entire surface thereof when etching openings through the gate electrode. The present invention also provides a gate electrode having good surface integrity and an undamaged top surface after the formation thereof.

Specifically, in one embodiment, the present invention comprises depositing a gate metal over an underlying substrate such that a layer of the gate metal is formed above the underlying substrate. In the present invention, the layer of the gate metal is deposited to a thickness approximately the same as the thickness desired for the gate electrode. Next, the present invention deposits polymer particles uniformly and consistently arranged onto the layer of gate metal. A sacrificial hard mask layer is then deposited over the polymer particles and the layer of the gate metal. In the present invention, the sacrificial hard mask layer is comprised of a material which is not adversely affected/substantially etched during the etching of the gate metal. The present invention removes the polymer particles and portions of the hard mask layer which overlie the polymer particles such that first regions of the layer of the gate metal are exposed, and such that second regions of the layer of the gate metal remain covered by the hard mask layer. After the removal step, the present invention etches through the first regions of the layer of the gate metal such that openings are formed completely through the layer of the gate metal at the first regions. After the openings have been formed, the present invention then removes the remaining portions of the hard mask layer which overlie the second regions of the layer of the gate metal.

In one embodiment, the gate metal is comprised of chromium. In such an embodiment, the present invention etches through the above-described first regions of the layer of chromium using a chlorine and oxygen-containing etch environment such that openings are formed completely through the layer of chromium at the first regions. For purposes of the present application, an etch environment refers to the etchants/gases/plasmas used to perform an etch. The present embodiment also exposes the underlying substrate to a fluorine-containing etch environment. In so doing, the present invention forms respective cavities in the underlying substrate beneath the openings formed through the layer of chromium at the first regions of the layer of chromium. After removing remaining portions of the hard mask layer which overlie the second regions of the layer of chromium, the present embodiment enlarges the respective cavities formed in the underlying substrate by exposing the respective cavities to a wet etchant.

In still another embodiment of the present invention, the gate metal is comprised of tantalum. In such an embodiment, the present invention etches through the above-described first regions of the layer of tantalum using a fluorine-containing etch environment such that openings are formed completely through the layer of tantalum at the first regions. The present embodiment also exposes the underlying substrate to the fluorine-containing etch environment. In so doing, the present invention forms respective cavities in the underlying substrate beneath the openings formed through the layer of tantalum at the first regions of the layer of tantalum. After removing remaining portions of the hard mask layer which overlie the second regions of the layer of tantalum, the present embodiment enlarges the respective cavities formed in the underlying substrate by exposing the respective cavities to a wet etchant.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrates embodiments of the invention and, together with the description, serve to explain the principles of the invention.

Prior Art

Prior Art

Prior Art

Prior Art

Prior Art

The drawings referred to in this description should be understood as not being drawn to scale except if specifically noted.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
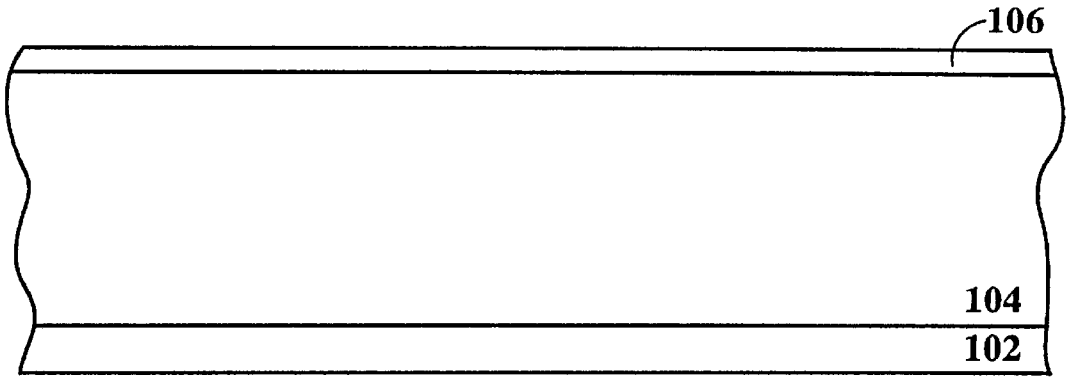
FIG. 1 (Prior Art)
FIG. 1 is a side sectional view illustrating a conventional step used during the formation of a prior art gate electrode.
Figure 2:
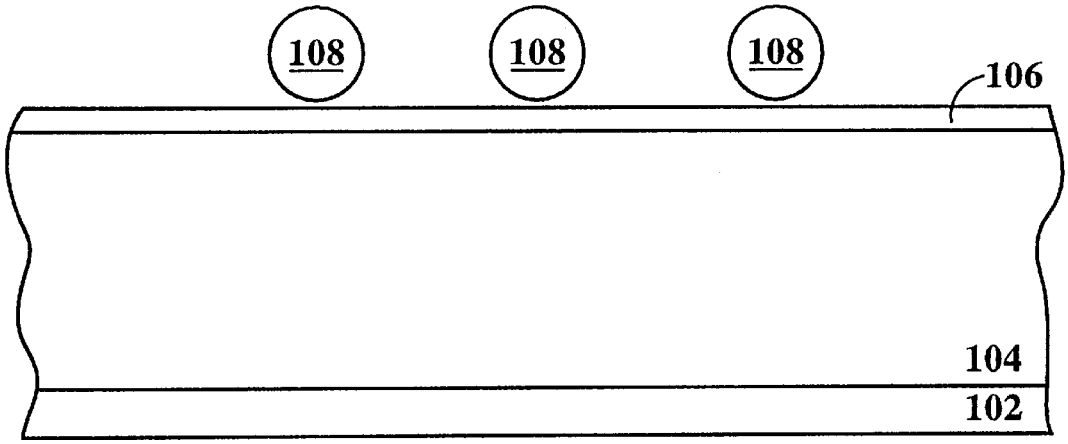
FIG. 2 (Prior Art)
FIG. 2 is a side sectional view illustrating another conventional step used during the formation of a prior art gate electrode.
Figure 3:
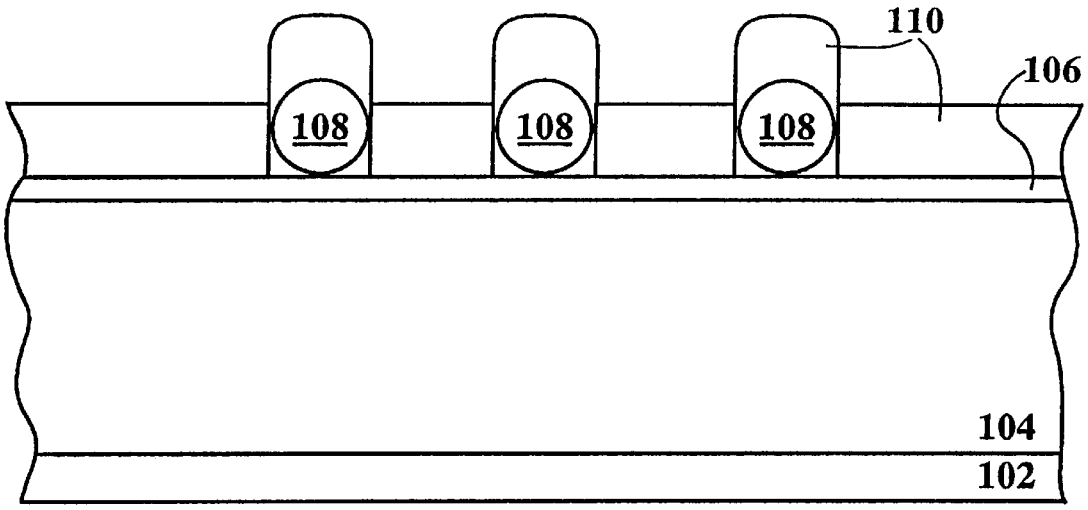
FIG. 3 (Prior Art)
FIG. 3 is a side sectional view illustrating yet another conventional step used during the formation of a prior art gate electrode.
Figure 4:
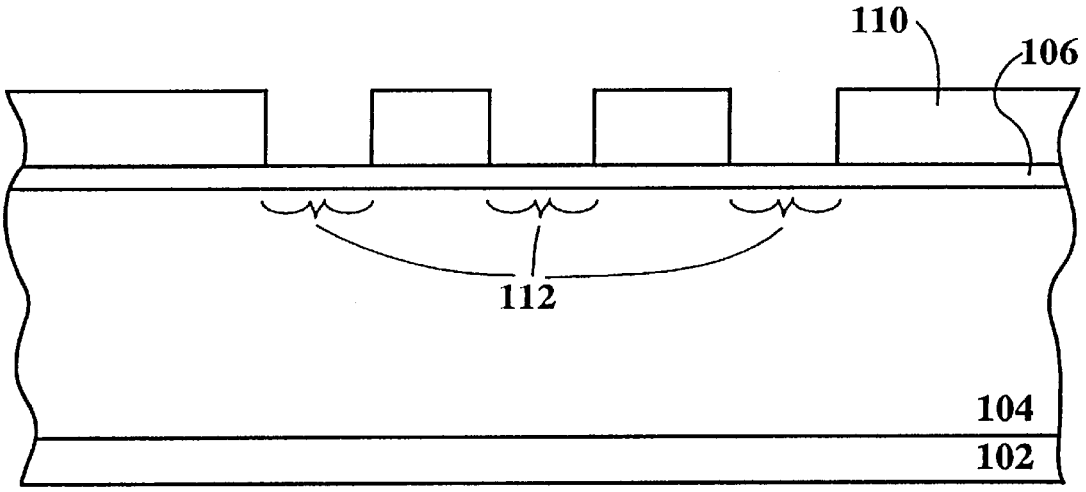
FIG. 4 (Prior Art)
FIG. 4 is a side sectional view illustrating another conventional step used during the formation of a prior art gate electrode.
Figure 5:
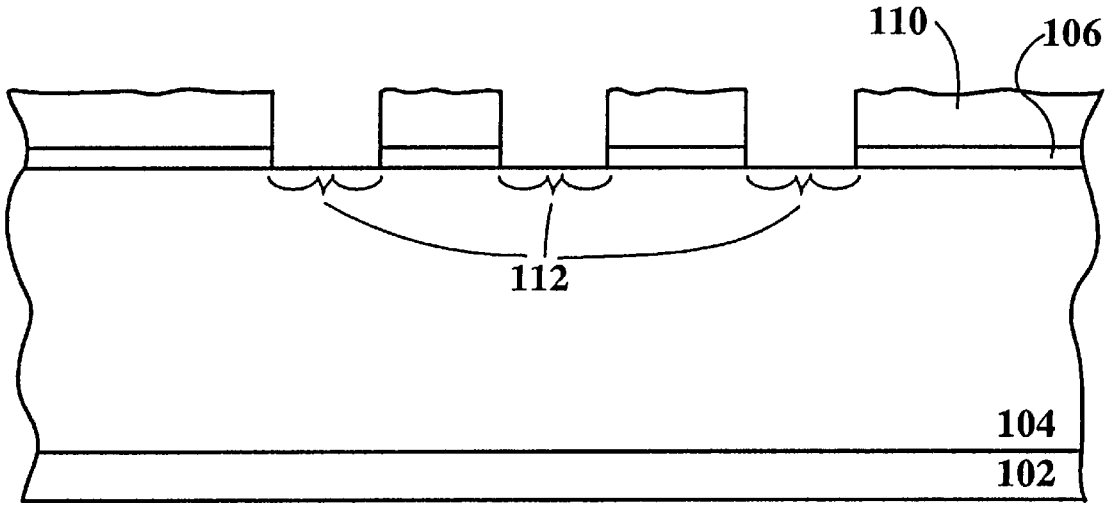
FIG. 5 (Prior Art)
FIG. 5 is a side sectional view illustrating another conventional step used during the formation of a prior art gate electrode.
Figure 6:
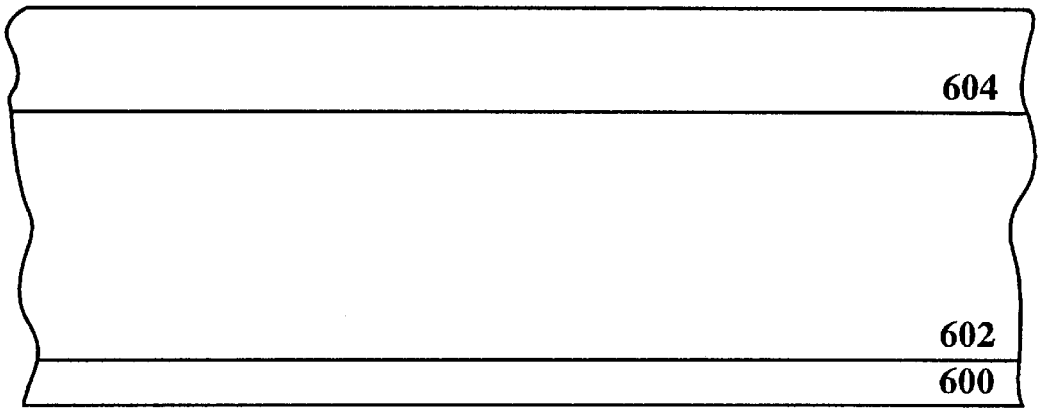
FIGS. 6–13 are side sectional view illustrating the formation of a gate electrode in accordance with the present claimed invention.

With reference to FIG. 6, a side sectional view illustrating a starting step of the present invention is shown. In the present embodiment, a first electrode 600 (e.g. a row electrode) has a layer 602 of dielectric material disposed thereover. In the present embodiment, dielectric layer 602 is comprised of, for example, silicon dioxide. The present invention is, however, well suited to the use of various other dielectric materials. Additionally, although not shown in FIG. 6, the present invention is also well suited for use in an embodiment which includes a resistive layer disposed between row electrode 600 and dielectric layer 602. Such a resistive layer is not shown in FIG. 6 and subsequent figures for purposes of clarity. In the present embodiment, dielectric layer 602 forms an underlying substrate for supporting a gate electrode. Thus, for purposes of the present application, dielectric layer 602 is referred to as the "underlying substrate".

Referring still to FIG. 6, gate metal is deposited over underlying substrate 602 such that a layer 604 of the gate metal is formed above underlying substrate 602. In the present invention, layer 604 of the gate metal is deposited to a thickness approximately the same as a desired thickness of the gate electrode to be formed. That is, unlike prior art gate electrode formation processes, the present invention does not require depositing gate metal to a thickness which is greater than the intended/desired thickness of the gate electrode being formed. In the present embodiment, layer 604 of the gate metal is deposited to a thickness in the range of approximately 300–1000 angstroms. By depositing the gate metal to such a thickness, the present invention achieves a gate metal layer 604 having consistent thickness and uniformity across the entire surface thereof. Hence, the present invention eliminates the very thin and discontinuous metal layers associated with conventional gate electrode formation processes. In one embodiment of the present invention, layer 604 of the gate metal is formed of chromium. In another embodiment, layer 604 of the gate metal is formed of tantalum. Although such metals are specifically recited, the present invention is not limited to the use of only chromium or tantalum.

Figure 7:
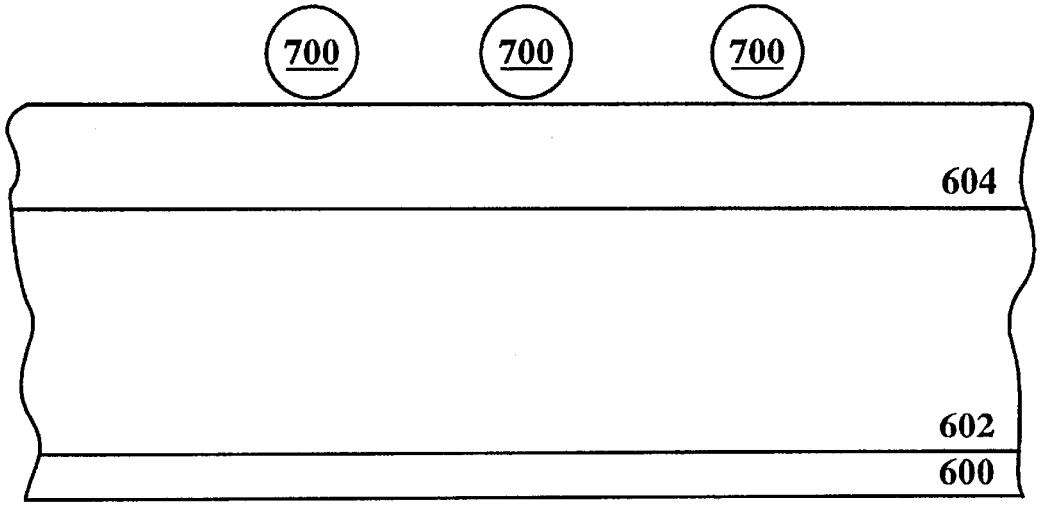

Referring now to FIG. 7, the present invention then deposits polymer particles or "spheres" 700 onto layer 604. In the present embodiment, the deposition of polymer particles 700 is accomplished using, for example, an electrophoretic deposition.

Referring again to FIG. 7, after the deposition of particles 700, the structure (i.e. row electrode 600, underlying substrate 602, layer 604, and newly deposited particles 700) is then dried.

With reference still to FIG. 7, due to the thick (e.g. 300–1000 angstroms), and hence less resistive, and continuous nature of layer 604, the present invention provides for improved uniformity in the spacing of particles 700. That is, the present invention improves the uniformity of particle spacing compared to conventional gate electrode formation processes.

Figure 8:
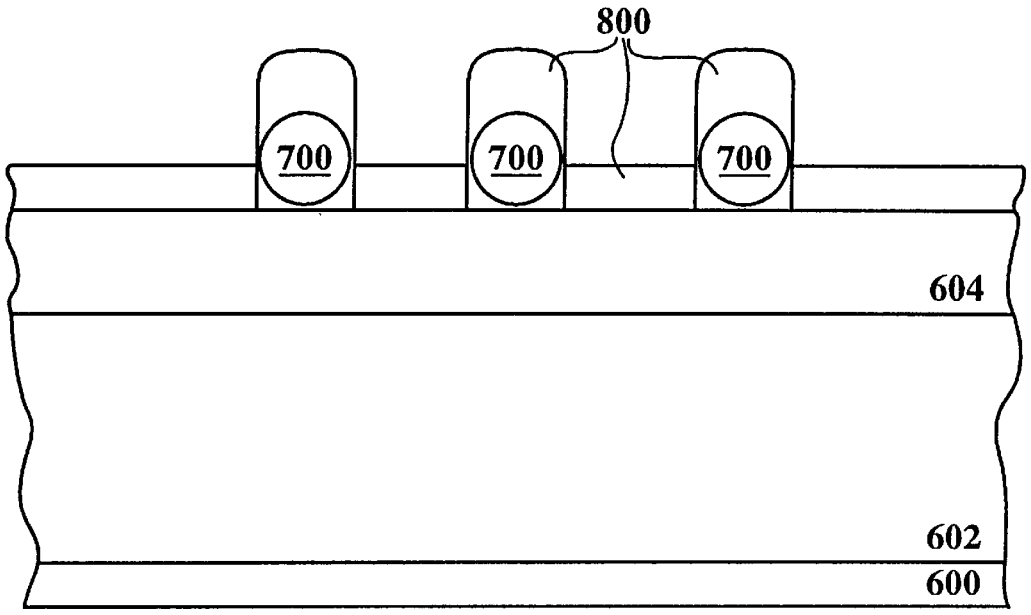

Referring now to FIG. 8, after the deposition of particles 700, the present invention deposits a sacrificial "hard mask layer" 800 over polymer particles 700 and layer 604. In the present invention, hard mask layer 800 is comprised of a material which has a significantly lower etch rate than the gate metal when subjected to a plasma etch environment used to etch the gate metal. That is, the sacrificial hard mask layer of the present invention is comprised of a material which is not adversely affected/substantially etched during the etching of the gate metal or other layers of the present structure. In the present embodiment, hard mask layer 800 is comprised of aluminum. Although aluminum is recited as the material of hard mask layer 800 in the present embodiment, the present invention is also well suited to the use of various other materials such as, for example, nickel, chromium, and the like. The choice of the hard mask layer is dependent upon the material comprising the various layers of the structure (i.e. the material comprising the row electrode, the resistive layer, the dielectric, the gate electrode, and the like). Additionally, in the present embodiment, hard mask layer 800 has a thickness of approximately 200–1000 angstroms.

Figure 9:
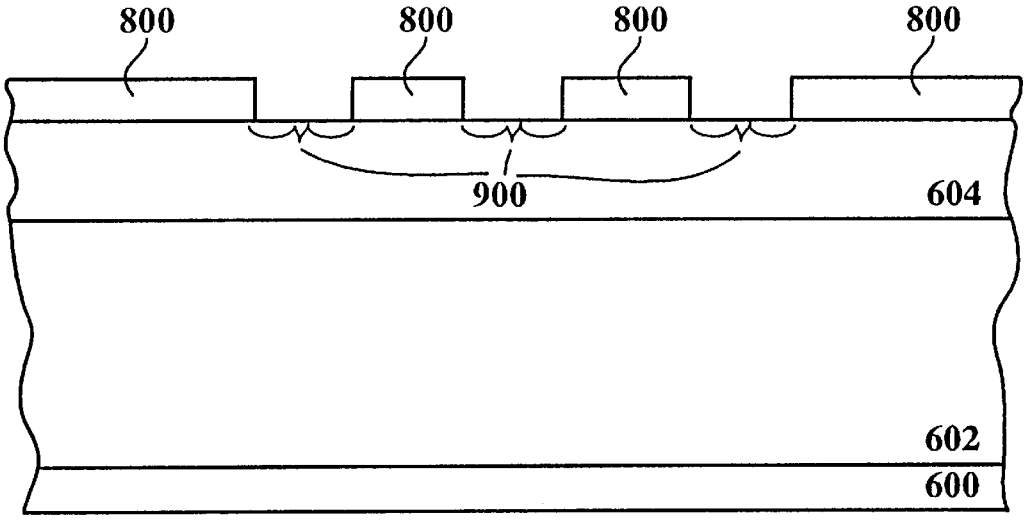

With reference next to FIG. 9, the present invention then removes particles 700. As a result, portions of hard mask layer 800 which overlie polymer particles 700 are also removed. Thus, as shown in FIG. 9, first regions, typically shown as 900, of layer 604 are exposed, and second regions of layer 604 remain covered by remaining portions of hard mask layer 800. In the present embodiment, polymer particles 700 are removed by immersing the structure in a bath of deionized water and subjecting the structure to mechanical stripping using, for example, sonic vibrations. More specifically, in one embodiment, the structure is disposed to sonic transducers, and vibrated at a frequency range needed to remove particles having a specific size range, and with a power range of approximately 50–200 watts for a period of approximately 5 minutes. The structure is then subjected to sonic transducers, and vibrated at a frequency range needed to remove particles having a specific size range, and with a power range of approximately 50–200 watts for a period of approximately 5 minutes. It will be understood that the present invention is also well suited to varying the parameters of the sonic particle removal process.

With reference still to FIG. 9, in another embodiment of the present invention, particles 700 are removed by subjecting particles 700 to a high pressure fluid spray in conjunction with a brushing (contact or non-contact) of particles 700.

Figure 10:
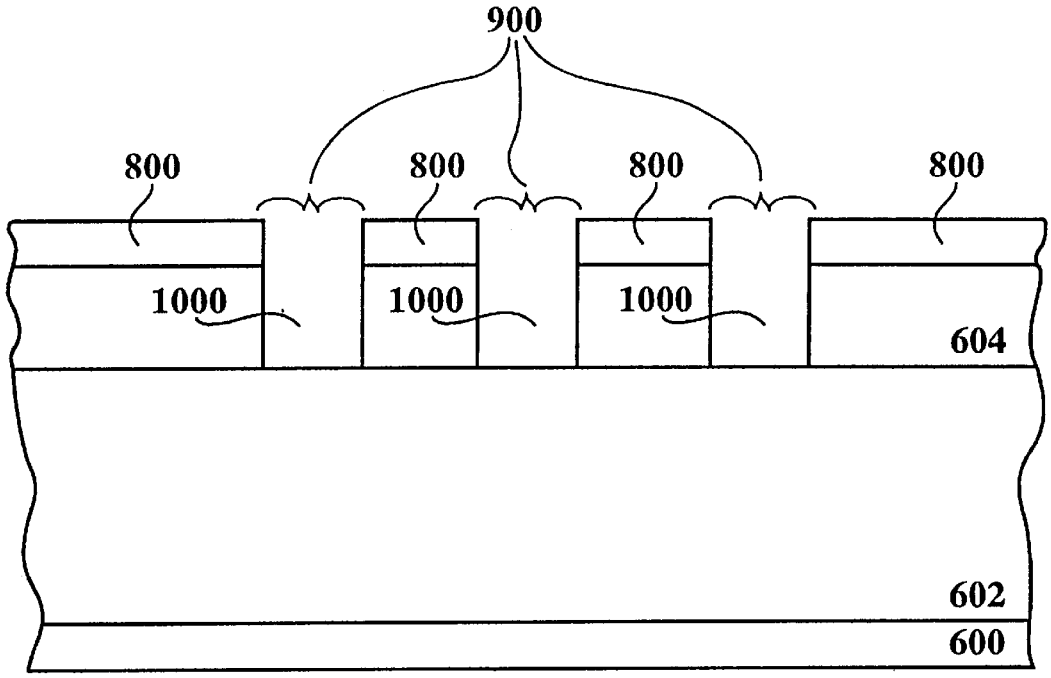

Referring next to FIG. 10, the present invention then etches through first regions 900 of layer 604 such that openings, typically shown as 1000, are formed completely through layer 604. In an embodiment where layer 604 is comprised of chromium, a chlorine and oxygen-containing etch environment is used to form openings 1000. In such an embodiment, the structure is subjected to a plasma etch environment comprising: a power of 500 watts; a bottom electrode bias of 20 watts; a temperature of 60 Celsius; and a pressure of 10–20 milliTorr for a period of approximately 40 seconds. In an embodiment where layer 604 is comprised of tantalum, a fluorine-containing etch environment (e.g. $CHF_3/CF_4$) is used to form openings 1000. In such an embodiment, the structure is subjected to a plasma etch environment comprising: a power of 400 watts; a bottom electrode bias of 80 watts; a temperature of 60 Celsius; and a pressure of 15 milliTorr for a period of approximately 160 seconds. The present invention is, however, well suited to varying the parameters of the plasma etch environment.

Referring still to FIG. 10, during the etching of openings 1000, hard mask layer 800 of the present invention protects the underlying top surface of layer 604 from the plasma environment. Thus, unlike conventional gate electrode formation processes, the present invention protects the top surface of layer 604 from, for example, oxidation. Hence, in the present invention, the condition of the top surface of layer 604 does not complicates other processes such as the removal of subsequently deposited emitter material. Therefore, the present invention provides a gate electrode with an undamaged top surface and which has good surface integrity.

Figure 11:
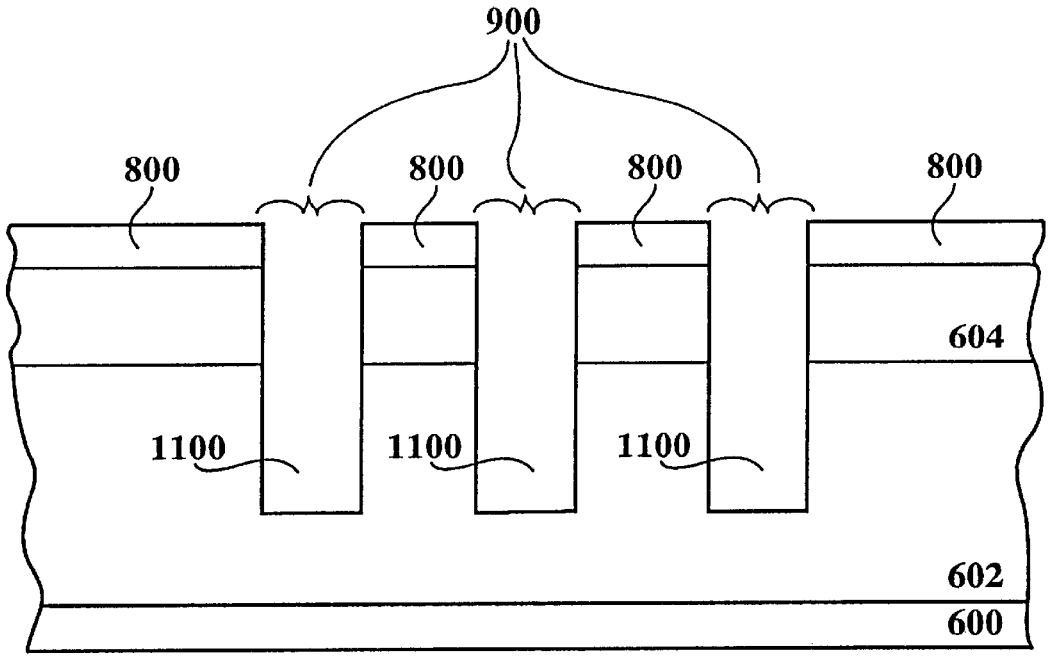

With reference now to FIG. 11, the present invention then etches through a substantial amount of the thickness of underlying substrate 602. In an embodiment where layer 604 is comprised of chromium and a chlorine and oxygen-containing etch environment was used to form openings 1000, the structure is then subjected to another etch environment which contains fluorine (e.g. $CHF_3/CF_4$). The fluorine etch environment is used to etch cavities 1100 in underlying substrate 602. In the present invention the change from the chlorine and oxygen-containing etch environment to the fluorine containing etch environment is made without breaking the vacuum of the etch environment. In an embodiment where layer 604 is comprised of tantalum and a fluorine-containing etch environment was used to form openings 1000, the same fluorine etch environment is used to etch cavities 1100 in underlying substrate 602.

With reference again to FIG. 11, during the etching of cavities 1100, hard mask layer 800 continues to protect the underlying top surface of layer 604 from the plasma environment. Thus, unlike conventional gate electrode formation processes, the present invention protects the top surface of layer 604 from, for example, oxidation.

Figure 12:
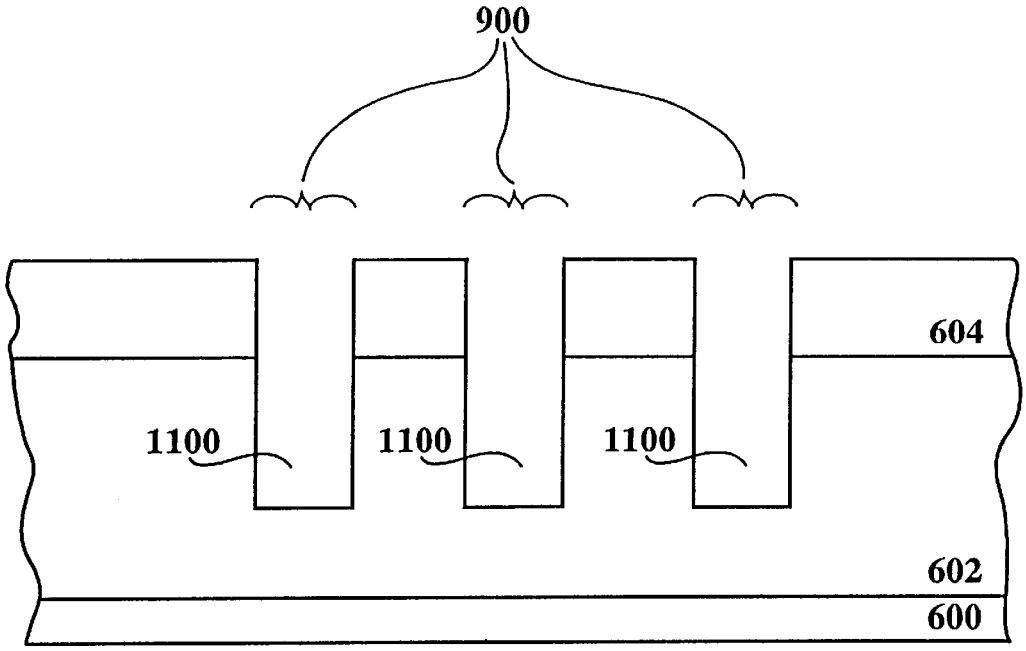

Referring now to FIG. 12, the present invention then removes remaining portions of hard mask layer 800 which overlie the second regions of layer 604. Thus, hard mask layer 800 protects the top surface of layer 604 during the etching of both layer 604, and underlying substrate 602. As a result, unlike prior art gate electrodes, the top surface of a gate electrode formed according to the present invention remains in pristine condition even after numerous etch steps. In the present embodiment, hard mask layer 800 is removed using a selective wet etch comprised of approximately 10 percent sodium hydroxide. Hard mask layer 800 can also be removed using various other etchants, however.

Figure 13:
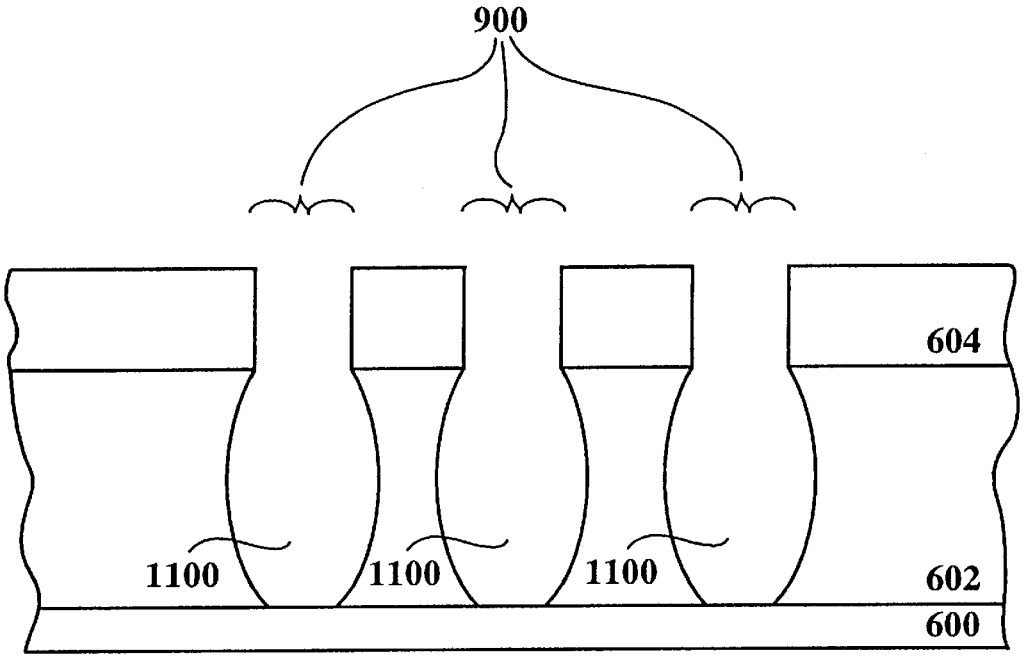

With reference next to FIG. 13, after the removal of hard mask layer 800, the present invention removes the remaining underlying substrate 602 and enlarges cavities 1100 formed in underlying substrate 602 by exposing cavities 1100 to a wet etchant. Hence, a gate electrode and corresponding underlying cavities have been formed by the present embodiment of this invention. By eliminating many of the disadvantages associated with conventional gate electrode formation processes, the present invention increases, yield, improves throughput, and reduces the costs required to form a gate electrode. Alternately, it is conceivable, for certain types of materials, that hard mask layer 800 can be removed during the wet etch (i.e. during the enlargement) of the cavities.

The present invention further comprises a method which does not reduce the thickness of the gate electrode across the entire surface thereof when etching openings through the gate electrode. The present invention also provides a gate electrode having good surface integrity and an undamaged top surface after the formation thereof.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications are suited to the particular use contemplated. It is intended that the scope of the invention be defined by the Claims appended hereto and their equivalents.

What is claimed is:

1. A method for forming a gate electrode, said method comprising the steps of:

a) depositing a gate metal over an underlying substrate such that a layer of said gate metal is formed above said underlying substrate, said layer of said gate metal deposited to a thickness approximately the same as a desired thickness of said gate electrode;

b) depositing polymer particles onto said layer of gate metal;

c) depositing a hard mask layer of aluminum over said polymer particles and said layer of said gate metal, said hard mask layer of aluminum having a thickness of approximately 200–1000 angstroms;

d) removing said polymer particles and portions of said hard mask layer which overlie said polymer particles using a high pressure fluid spray in conjunction with a brushing such that first regions of said layer of said gate metal are exposed, and such that second regions of said layer of said gate metal remain covered by said hard mask layer;

e) etching into said first regions of said layer of said gate metal such that openings are formed into said layer of said gate metal at said first regions, said second regions of said layer of said gate metal protected from said etching by said hard mask layer; and f) removing remaining portions of said hard mask layer which overlie said second regions of said layer of said gate metal.

2. The method for forming a gate electrode as recited in claim 1 wherein step d) comprises removing said polymer particles and portions of said hard mask layer which overlie said polymer particles using a high pressure fluid spray in conjunction with a non-contact brushing such that first regions of said layer of said gate metal are exposed, and such that second regions of said layer of said gate metal remain covered by said hard mask layer.

3. The method for forming a gate electrode as recited in claim 1 wherein step d) comprises removing said polymer particles and portions of said hard mask layer which overlie said polymer particles using a high pressure fluid spray in conjunction with a contact brushing such that first regions of said layer of said gate metal are exposed, and such that second regions of said layer of said gate metal remain covered by said hard mask layer.

4. A method for forming a gate electrode, said method comprising the steps of:

a) depositing a gate metal comprising chromium over an underlying substrate such that a chromium layer of said gate metal is formed above said underlying substrate, said chromium layer of said gate metal deposited to a thickness approximately the same as a desired thickness of said gate electrode;

b) depositing polymer particles onto said chromium layer of gate metal;

c) depositing a hard mask layer over said polymer particles and said chromium layer of said gate metal;

d) removing said polymer particles and portions of said hard mask layer which overlie said polymer particles such that first regions of said chromium layer of said gate metal are exposed, and such that second regions of said chromium layer of said gate metal remain covered by said hard mask layer;

e) etching into said first regions of said chromium layer of said gate metal using a chlorine and oxygen-containing etch environment such that openings are formed into said chromium layer of said gate metal at said first regions, said second regions of said chromium layer of said gate metal protected from said etching by said hard mask layer; and f) removing remaining portions of said hard mask layer which overlie said second regions of said chromium layer of said gate metal.

5. The method as recited in claim 4 wherein step e) further comprises the step of:

e1) exposing said underlying substrate to a fluorine-containing etch environment after exposure to said chlorine and oxygen-containing etch environment to form respective cavities in said underlying substrate beneath said openings formed into said chromium layer of said gate metal at said first regions of said chromium layer of said gate metal.

6. The method as recited in claim 5 further comprising the step of:

g) enlarging said respective cavities formed in said underlying substrate by exposing said respective cavities to a wet etchant.

7. A method for forming a gate electrode, said method comprising the steps of:

a) depositing a gate metal comprising tantalum over an underlying substrate such that a tantalum layer of said gate metal is formed above said underlying substrate, said tantalum layer of said gate metal deposited to a thickness approximately the same as a desired thickness of said gate electrode;

b) depositing polymer particles onto said tantalum layer of gate metal;

c) depositing a hard mask layer over said polymer particles and said tantalum layer of said gate metal;

d) removing said polymer particles and portions of said hard mask layer which overlie said polymer particles such that first regions of said tantalum layer of said gate metal are exposed, and such that second regions of said tantalum layer of said gate metal remain covered by said hard mask layer;

e) etching into said first regions of said tantalum layer of said gate metal using a fluorine-containing etch environment such that openings are formed into said tantalum layer of said gate metal at said first regions, said second regions of said tantalum layer of said gate metal protected from said etching by said hard mask layer; and f) removing remaining portions of said hard mask layer which overlie said second regions of said tantalum layer of said gate metal.

8. The method as recited in claim 7 wherein step e) further comprises the step of:

e1) exposing said underlying substrate to said fluorine-containing etch environment after exposure to said fluorine-containing etch environment to form respective cavities in said underlying substrate beneath said openings formed into said tantalum layer of said gate metal at said first regions of said tantalum layer of said gate metal.

9. The method as recited in claim 8 further comprising the step of:

g) enlarging said respective cavities formed in said underlying substrate by exposing said respective cavities to a wet etchant.

* * * * *